United States Patent [19]

Grave

[11] Patent Number: 4,466,155

[45] Date of Patent: Aug. 21, 1984

[54] RECYCLING CLEANING APPARATUS

[76] Inventor: Dale L. Grave, 1250 N. Queensland La., Plymouth, Minn. 55447

[21] Appl. No.: 443,224

[22] Filed: Nov. 22, 1982

[51] Int. Cl.[3] ..... A47L 11/30

[52] U.S. Cl. ..... 15/321; 15/353; 210/332; 210/409

[58] Field of Search ..... 15/320, 321, 353; 210/167, 409, 332

[56] References Cited

U.S. PATENT DOCUMENTS

| | | | |
|---|---|---|---|
| 1,670,934 | 5/1928 | Keefer . | |
| 2,223,963 | 12/1940 | Nadig | 141/1 |
| 2,889,048 | 6/1959 | Nordin | 210/409 |
| 3,431,582 | 3/1969 | Grave | 15/321 |
| 3,674,148 | 7/1972 | Miller et al. | 210/409 |
| 3,940,826 | 3/1976 | Phillips et al. | 15/320 |
| 3,942,214 | 3/1976 | Maasberg | 15/340 X |
| 4,138,761 | 2/1979 | Nauta | 15/321 X |

FOREIGN PATENT DOCUMENTS

| | | | |
|---|---|---|---|
| 584806 | 10/1959 | Canada | 15/321 |

*Primary Examiner*—Chris K. Moore

*Attorney, Agent, or Firm*—Leo Gregory

[57] ABSTRACT

An apparatus for cleaning hard surfaces and surface coverings such as rugs and upholstery material, consisting of a tank of cleaning fluid, an outlet line running to a cleaning head, a pump in connection with the outlet line, a vacuum motor with an inlet line recovering cleaning fluid through the cleaning head, filters in the tank in connection with the inlet and outlet lines, a stream cleaning the outlet filter and centrifuging the cleaning fluid in the tank separating out contaminants leaving a body of cleaning fluid substantially free of particulate matter to recycle whereby for example, a tank of six gallons of cleaning fluid can accomplish the effective cleaning effort for which would be required on the order of sixty gallons of uncycled cleaning fluid.

5 Claims, 4 Drawing Figures

10
12
14
16
20
22
24
27
41
42
45
48
48a
52
53
53a
53b
54
57
59
60
60a
61
62
63
64
64a
65
66
70
72
74
75
76
77
84
85
95
97

RECYCLING CLEANING APPARATUS

BACKGROUND OF THE INVENTION

1. Field of the Invention.

This invention relates to the field of cleaning apparatus for various surfaces.

2. Description of the Prior Art.

There are known to be in the prior art cleaning machines which apply a cleaning fluid and provide for its recovery and further use.

Illustrative of the prior art is the disclosure in the U.S. Pat. No. 2,223,963 to Nadig in which a rotary head distributes the cleaning fluid and in which a pair of blowers provide for suction through an inlet pipe to recover the cleaning fluid from the cleaning area for recycled use. There is no provision herein for removing contaminants from the recovered fluid prior to the recycling effort.

The U.S. Pat. No. 1,670,934 to Keefer discloses a scrubbing machine in which a scrubbing brush mounted upon a horizontal axis is used and a fan is used to create suction in the scrubbing chamber. As a result of the cleaning effort, the mixture of air, dirt and cleaning fluid is removed by suction into a chamber wherein the fluid and dirt settle and a pump is provided which attempts to recover the fluid from said chamber.

The U.S. Pat. No. 3,431,582 issued to the applicant herein discloses a machine in which a suction is provided to recover the cleaning fluid at the expiration of a cleaning cycle, conveying the same to a reservoir, and prior to commencement of a new cleaning cycle, separating the soil from the fluid for re-use of the cleaning fluid.

There appears to be a need for improvement in removing contaminants from cleaning fluid used in a recycling effort.

SUMMARY OF THE INVENTION

The invention herein in connection with cleaning apparatus places particular emphasis upon the removal of contaminants or soil from the cleaning fluid used by means of a suitably effective filter arrangement. The words contaminants and soil are used interchangeably herein.

It is an object of this invention to provide a reservoir for cleaning fluid from which the fluid is drawn for cleaning purposes and to which recovered fluid is returned wherein contaminants in significant quantities are removed from the recovered fluid providing a sufficiently clean body of fluid for a continuous non-interrupted recycling use.

More particularly it is an object of this invention to provide in the cleaning fluid reservoir an arrangement of filters wherein the recovered fluid is filtered upon re-entering the reservoir, the recycled fluid is further filtered upon being withdrawn from said reservoir, the filter is either constantly or intermittently cleaned off through which said liquid is withdrawn and the fluid in the reservoir is centrifugally moved to aid in the separation therefrom contaminants which either settle to the bottom of the reservoir or rise to the top of the body of fluid therein leaving a central portion of the body of cleaning fluid substantially free from contaminants.

The apparatus to be described hereinafter represents a significant improvement in the surface cleaning art.

These and other objects and advantages of the invention will be set forth in the following description made in connection with the accompanying drawings in which like reference characters refer to similar parts throughout the several views.

BRIEF DESCRIPTION OF THE DRAWINGS

FIG. 1 is a view in side elevation;

DESCRIPTION OF A PREFERRED EMBODIMENT

Figures 2, 4:
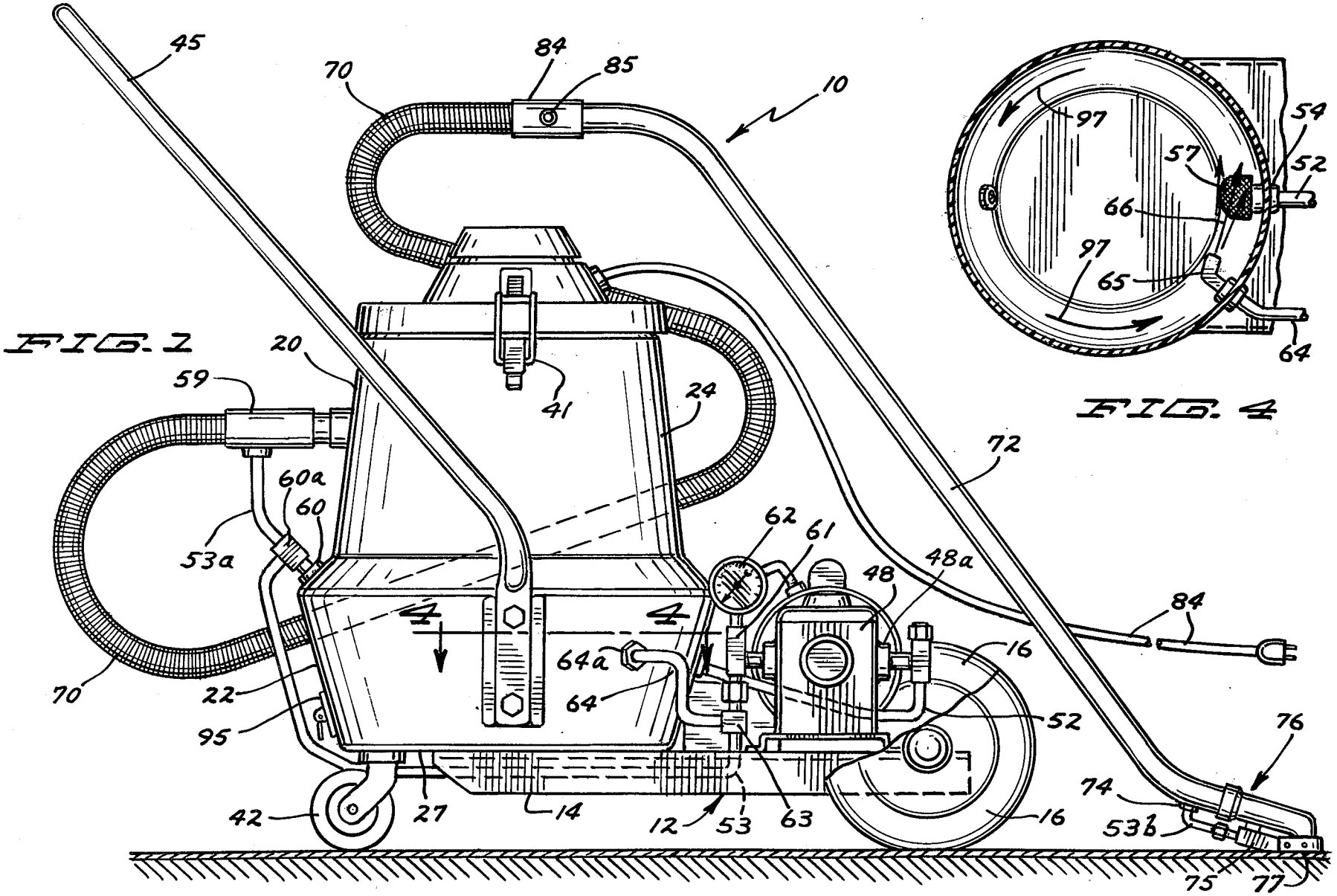
FIG. 2 is a top plan view.
FIG. 4 is a view in horizontal section taken on line 4—4 of FIG. 1 as indicated.
Figure 2:
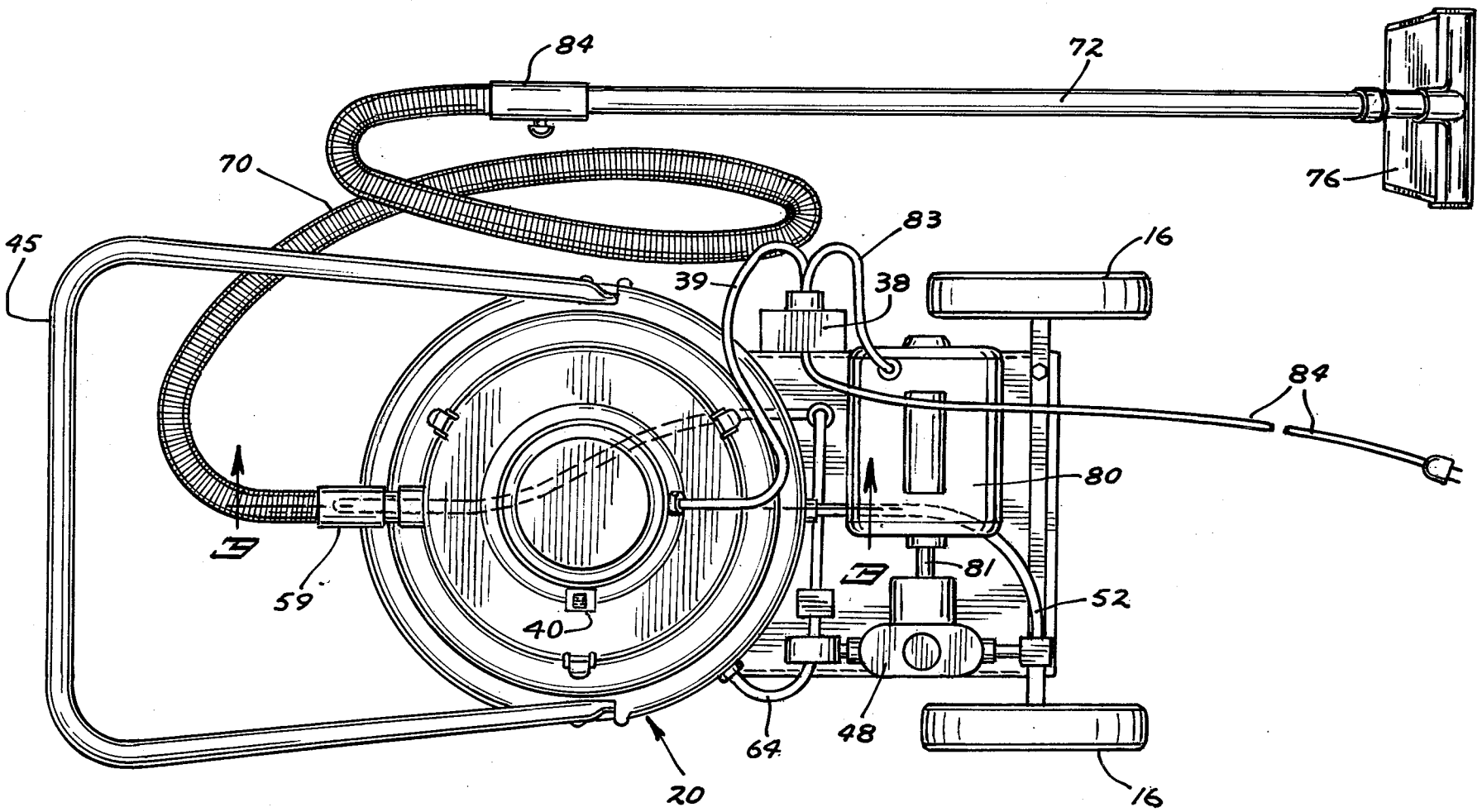
Figure 3:
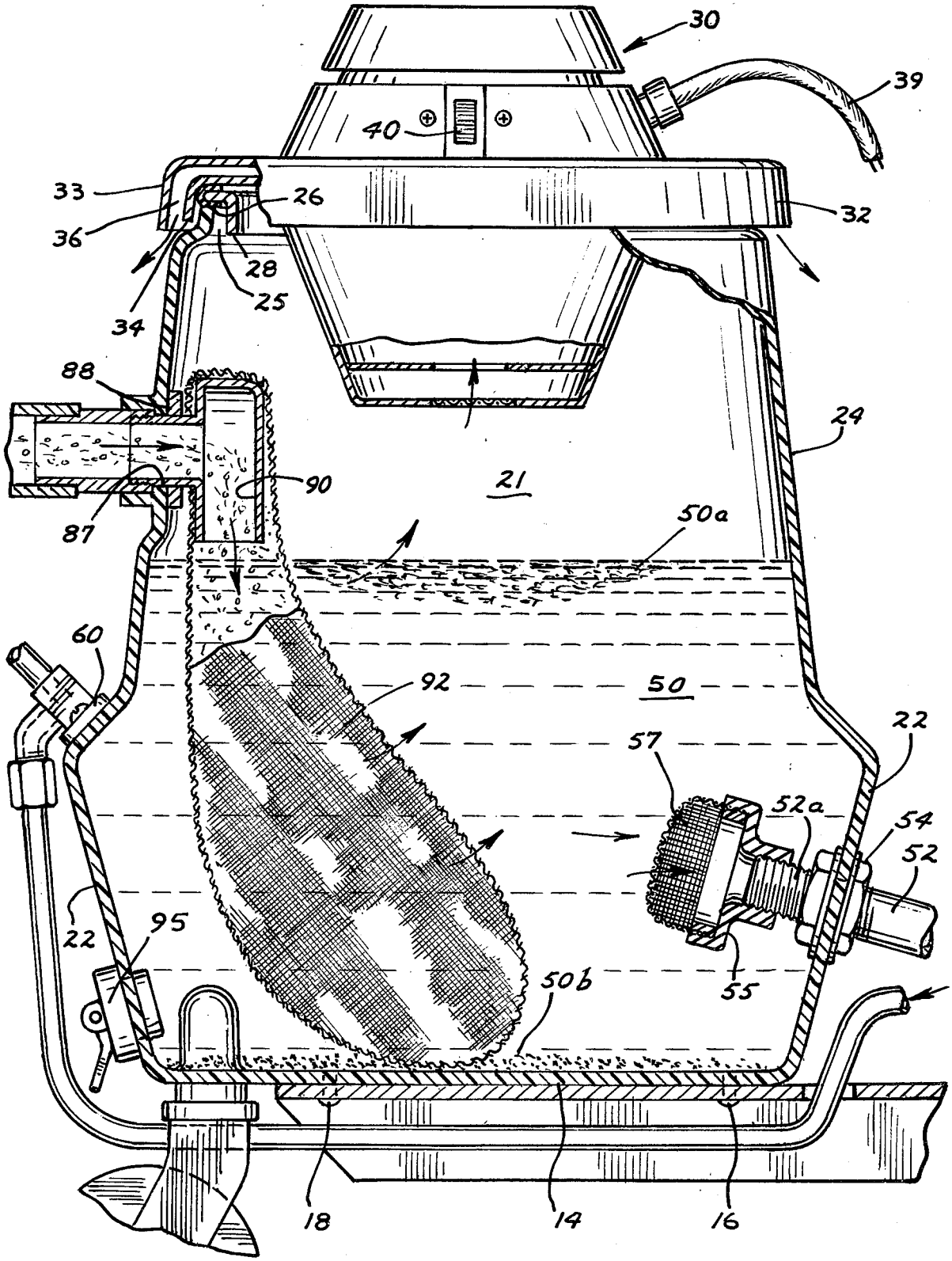
FIG. 3 is a view in horizontal section taken on line 3—3 of FIG. 2 as indicated.

Referring to the drawings, the cleaning apparatus comprising the invention herein is indicated generally by the reference numeral 10.

Supporting said apparatus is a chassis 12 comprising a supporting bottom plate member 14 having conventionally secured thereto a pair of front wheels 16.

Mounted upon said plate member 14 secured thereto as by screws 18 is a tank 20 circular in cross section comprising a lower portion 22 shown having an outwardly flared annular wall and an upper portion 24 of reduced width and tapering upwardly having an open top 25 having a rim 26. Supported upon said rim and extending inwardly of said open top is an annular skirt 28.

Overlying said open top and depending inwardly thereof is a vacuum motor 30 of conventional construction having a housing substantially cylindrical in form having a circular cover 32 with a depending rim 33 thereabout, said cover having spaced inwardly thereof an annular flange 34 forming an exhaust passage 36 with said rim 33 deflecting downwardly the air movement caused by the operation of said vacuum motor 30. A line 39 runs from said vacuum motor to a junction box 38 from which a line 84 runs to a power source. Said vacuum motor is shown having an on-off switch 40. Securing said rim to the upper body portion 24 of said tank is a conventional clamp 41.

Said vacuum motor is operation creates a partial vacuum within said tank 20 as will be further described.

Shown supporting the rear portion of said tank is a pair of castors 42 suitably secured to the bottom wall 27 of said tank. Suitably secured to each side of said lower tank portion 22 and being angled upwardly rearwardly therefrom is a U-shaped handle 45.

Mounted forwardly of said tank 20 upon said plate member 14 is a water pump 48 capable of developing high pressure of suitable design and capacity to carry out the operation hereinafter described.

Carried within said chamber 21 is a suitable cleaning fluid 50. For purpose of illustration, the tank 20 is characterized as having a working capacity of six gallons of cleaning fluid.

Said pump 48 draws cleaning fluid from said tank through a line 52 which extends into said tank portion 22 through a seal fitting 54 having mounted on the inwardly extending threaded portion **52*a* thereof a receptacle member 55 having removably mounted thereon a rigid filter 57** of a suitable fine mesh.

Said pump draws cleaning fluid through the outlet or discharge line 52 into the pump intake indicated at **48*a* and under the pump pressure forces or drives the fluid downstream thereof through a continuation of the line 52 which is indicated as 53, 53*a* and 53*b* and the line portion 53***b* for purpose of convenience passes through the flexible hose 70 and its rigid extension 72 emerging through the sealed fitting 74 to be connected with the cleaning head 76 and more particularly with the cleaning nozzle 75 of said cleaning head.

A pressure gauge 62 is mounted onto the line 53 at the discharge side of said pump 48 to indicate the working line pressure of the cleaning fluid.

A conventional by-pass valve arrangement not futher described is indicated at 61 in communication with the line downstream of the gauge 62 to regulate the line pressure of the cleaning fluid.

A line 64 through an appropriate valve fitting 63 bleeds fluid from, communicates with the line 53, and has a jet terminal extending into the tank portion 22 through an appropriate seal fitting 64*a*. Said line 64 as indicated in FIG. 4 bleeds fluid from the line 53 while the pump 48 is operating and thereby directs a constant or intermittent stream, as the case may be, upon the filter 57 to maintain the filter in a clean unobstructed condition as cleaning fluid is being withdrawn from said tank in a cleaning cycle.

To further describe said line 53 as here illustrated, it is shown extending under the chassis 12 to come up rearwardly thereof to a bracket 60 suitably secured to said tank portion 22 as by screws or rivets and carrying a coupling member 60*a* from which the extension 53*a* of said line 53 extends into and through an appropriate fitting or coupling member 59 to pass into and through said line 70.

Said cleaning head 76 which combines the operation of said cleaning nozzle 75 with a suction nozzle 77 (not further herein described) is integral with the rigid inlet or suction line portion 72 which is a continuation of the flexible suction line or hose 70.

Driving said pump 48 is a motor 80 mounted upon said chassis 12 and adjacent said pump 48 and being operatively connected thereto by a drive shaft 81. A power supply line 83 runs from said motor to said junction box 38 as shown and from sand junction box to said line 84 connected as indicated to an appropriate power source, such as a 110 VAC power source.

Connecting said line portions 70 and 72 is a valve housing 84 which has therein a control valve 85 which, in a conventional manner not here shown, controls the passage of cleaning fluid 50 through the line 53—53*b*.

Said inlet or suction line 70–72 communicates with said chamber 21 through the coupling member 59 which in a conventional manner has an extension through said upper tank portion 24 and into said chamber 21 through an opening 87 secured by a seal member 88. Said line 70 has extending inwardly into said chamber an angled outlet 90 having depending therefrom a large flexible suitably fine meshed filter 92 through which incoming fluid passes to merge with the body of cleaning fluid 50 within said chamber.

Incoming cleaning fluid contains the contaminants picked up in the cleaning process (to be described). Those contaminants which are substantially non-miscible and have a specific gravity less than that of the fluid 50 rise to the surface thereof and the fine contaminants which pass through the filter having a specific gravity greater than that of the fluid 50 tend to precipitate as indicated at 50*b*. A significant amount of soil will be retained within the filter.

Referring to FIG. 4, the indicated stream 66 discharged from the jet 65 to bear upon the filter 57 serves continually or intermittently (as the case may be) to wash off and keep clean the outer surface of said filter but said stream also performs a very significant function. It additionally tends to apply a centrifugal force upon said body of fluid 50 causing sufficient rotary movement of said body to assist in bringing about the separation of the particles 50*a* and 50*b* from the main body of fluid and which in turn results in the large central portion of said body of liquid to be rid of much of the contaminants picked up during its cleaning cycles.

A conventional drain 95 is shown suitably mounted adjacent the rear bottom of said tank 20.

OPERATION

The operation of the apparatus herein will be fairly well understood from the description given.

A tank size of six gallons is believed to be a convenient size. It has been ascertained that when six gallons of fluid are used on a recycling basis of two gallons a minute over a thirty minute period that said six gallons has the cleaning effect of sixty gallons of uncycled cleaning fluid in a conventional prior art operation. This represents a substantial improvement in conserving and getting improved cleaning performance and more economy than otherwise in the use of water and cleaning chemicals. Reduced substantially and to a minimum is the waste water discharged to the environment.

The pump 48 is of a design which taken together with the motor 80 produces a range of pressures from 20 psi to 10,000 psi of working fluid pressures. This is a wide range of available pressures to accommodate the variety of surfaces which may be cleaned. A suitable average fluid flow rate depending for variance upon a given cleaning requirement has been found to be on the order of one half gallon per minute for each nozzle or jet 75 used at 500 psi. Under average conditions this produces a good cleaning effect. For cleaning rugs, for example, the cleaning head 76 may contain such as four cleaning jets or nozzles having four streams of cleaning fluid directed upon the area being cleaned.

Operating simultaneously with the application of cleaning fluid is the vacuum drawn upon the chamber 21 by the vacuum motor 30 in creating suction through the inlet line 70–72. A suitable suction for the operation of the vacuum system is in the range of drawing 60" to 300" of water.

The nozzle 76 which is shown for the purpose of illustrating the operation herein in being applied to a surface to be cleaned has the application of cleaning fluid and the withdrawal or recovery thereof in a simultaneous action with the pump 48 and the vacuum motor 30 operating at the same time. If desired, the suction effort may be used alone for a further extraction of moisture from a cleaned area. The suction will be such as to recover substantially all of the cleaning fluid used except for what may be regarded as a residue of dampness in the pile of a rug cleaned or in the material of upholstery cleaned.

The stream of liquid 66 which is constant upon the filter head 57 has been found to very effectively cause the centrifugal motion of the liquid 50 as indicated by the arrows 97 in FIG. 4. This action very successfully causes a separation out of the liquid 50 of contaminants at 50*a* and 50*b* providing a substantially contaminant free cleaning fluid for recycling purposes. In effectively accomplishing with the use of six gallons recycled fluid the equivalent benefit of 60 gallons of uncycled cleaning fluid and a like saving in the detergent and supplementary cleaning chemicals which would otherwise be used, there is in the operation of the apparatus herein a very significant saving of material and expense and a very great reduction in the amount of waste water to be discharged into the environment.

Although indicated herein but not specifically described but desirable in some cleaning situations, is the intermittent operation of the application of cleaning fluid. This action may be put into effect readily by operation of the valve 85.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. A recycling cleaning apparatus, having in combination a cleaning fluid reservoir having a body of cleaning fluid therein, cleaning means applied to a cleaning area, a high pressure pump passing said cleaning fluid to said means, a vacuum motor having means in connection with and drawing a vacuum upon said cleaning means and recovering said cleaning fluid from said cleaning area into said reservoir, inlet filter means within said reservoir receiving and passing through said recovered cleaning fluid, an outlet filter within said reservoir through which is drawn recycled cleaning fluid, means cleaning the surface of said outlet filter, said last mentioned means comprises a fluid stream, means directing said stream to sweep the surface of said filter, and means passing said stream to said last mentioned means with sufficient velocity as to engage and cause said body of cleaning fluid to have motion.

2. A recycling cleaning apparatus, having in combination a housing having a reservoir, means movably supporting said housing, a body of cleaning fluid in said reservoir, an outlet line from said reservoir, a cleaning head carried by the outer end of said outlet line, a pump in connection with said reservoir driving said cleaning fluid from said reservoir through said outlet line to said cleaning head, an inlet line running from said cleaning head to said reservoir, a vacuum motor having means in connection with said reservoir drawing a vacuum upon said reservoir and said inlet line, a filter carried by said inlet line within said reservoir, an outlet filter carried upon said outlet line within said reservoir, a line extending into said reservoir bleeding a stream of said fluid from said outlet line, means in connection with said bleeding line directing said stream of fluid to sweep said outlet filter, and said last mentioned means causing said stream to impact upon and give motion to said body of cleaning fluid in said reservoir.

3. The structure of claim 2, wherein said outlet filter comprises a rigid mesh structure.

4. The structure of claim 2, wherein said outlet filter is positioned within said reservoir to be within the body of cleaning fluid therein.

5. A recycling cleaning apparatus having in combination a portble housing having therein a reservoir of cleaning fluid, a cleaning means applied to a cleaning area, means passing said cleaning fluid to said cleaning means, a vacuum motor and connecting means drawing a vacuum upon said cleaning means recovering said cleaning fluid and passing the same to said reservoir, means associated with said connecting means filtering said recovered cleaning fluid, and means in connection with reservoir causing the body of cleaning fluid therein to have motion, said second mentioned means includes a filter carried within a body of cleaning fluid within said reservoir, and said last mentioned means causes cleaning fluid to wash said filter in causing said body of cleaning fluid to have motion.

* * * * *